US006024592A

United States Patent [19]

Pai et al.

[11] Patent Number: 6,024,592

[45] Date of Patent: Feb. 15, 2000

[54] CARD CONNECTOR

[75] Inventors: Lie-Ming Pai, Tu-Chen; Liu Jia Hung, Hsin-Chuang; Yu-San Hsiao, Tu-Chen, all of Taiwan

[73] Assignee: Hon Hai Precision Ind. Co., Ltd., Taipei Hsien, Taiwan

[21] Appl. No.: 09/028,948

[22] Filed: Feb. 24, 1998

[30] Foreign Application Priority Data

Feb. 28, 1997 [TW] Taiwan ..... 86203326

[51] Int. Cl.[7] ..... H01R 13/62

[52] U.S. Cl. ..... 439/326

[58] Field of Search ..... 439/326, 327, 439/328, 64, 83, 629

[56] References Cited

U.S. PATENT DOCUMENTS 5,755,585 5/1998 Cheng et al. ..... 439/326

5,833,478 11/1998 Tseng et al. ..... 439/326

5,860,825 1/1999 Yodogawa ..... 439/326

*Primary Examiner*—Khiem Nguyen

[57] ABSTRACT

A card connector for receiving a complementary card includes an elongate insulative housing having a first elongate wall, a second elongate wall opposite the first elongate wall and defining a plurality of passageways therein, a slot defined between the first and the second elongate walls and communicating with the passageways, and first and second supporting arms respectively and integrally formed with the two elongate walls and extending substantially perpendicular therefrom. A plurality of contacts are received in the passageways and project into the slot. First and second elastic locking members extend from two distal ends of the first elongate wall and are spaced from the first and second supporting arms for engagement with the complementary card which is inserted into the slot of the housing, wherein the locking members are manually bent outward with respect to an axis therebetween for releasing the engagement between the complementary card and the connector.

9 Claims, 5 Drawing Sheets

CARD CONNECTOR

BACKGROUND OF THE INVENTION

1. Field of the Invention

The present invention relates to a card connector, and particularly to a card connector which may be firmly maintained in position on a motherboard of a personal computer during a wave soldering procedure of the motherboard as well as during insertion/withdrawal of a complementary card into/from the card connector.

2. The Prior Art

Card connectors fixed on a motherboard of a personal computer are often used to receive expansion cards. Conventional card connectors include an elongate housing having a U-shaped cross section for receiving an inserted expansion card. The card connector is fixed to the motherboard through a first wave soldering procedure during which the related soldering pins of the card connector are soldered to the conductive pads of the motherboard, a reversed procedure for inverting the motherboard together with the card connector for insertion of other electrical components on an opposite side thereof, and a second wave soldering procedure during which all the components including the card connector are soldered and firmly fixed to the motherboard. However, the card connector is apt to become loosened and disengage from the motherboard during the reversed procedure due to gravity.

Moreover, the soldering engagement region between the soldering pins of the card connector and the motherboard is apt to break due to frequent insertion/withdrawal of the expansion card into/from the card connector thus affecting the transmission of electrical signals between the expansion card and the motherboard. Most manufacturers manually apply glue to reinforce the soldering engagement between the card connector and the motherboard; however, this procedure is time and cost inefficient thereby adversely affecting automated assembly.

SUMMARY OF THE INVENTION

The primary purpose of the present invention is to provide an improved card connector which may be firmly positioned on a motherboard before a wave soldering procedure, therefore when the motherboard is inverted during the wave soldering procedure, the card connector is firmly fixed on the motherboard thereby promoting efficiency of the entire assembly process thereof. Furthermore, the improved card connector allows for insertion/withdrawal of a complementary card without damaging the engagement between contacts thereof and the motherboard.

In accordance with one aspect of the present invention, a card connector for receiving a complementary card comprises an elongate insulative housing including a first elongate wall, a second elongate wall opposite the first elongate wall and defining a plurality of passageways therein, a slot defined between the first and the second elongate walls and communicating with the passageways, and first and second supporting arms respectively and integrally formed with the two elongate walls and extending substantially perpendicular therefrom. A plurality of contacts are received in the passageways and project into the slot. First and second elastic locking members extend from two distal ends of the first elongate wall and are spaced from the first and second supporting arms for engagement with the complementary card which is inserted into the slot of the housing, wherein the locking members are manually bent outward with respect to an axis therebetween for releasing the engagement between the complementary card and the connector.

DETAILED DESCRIPTION OF THE PREFERRED EMBODIMENT

Figure 1:
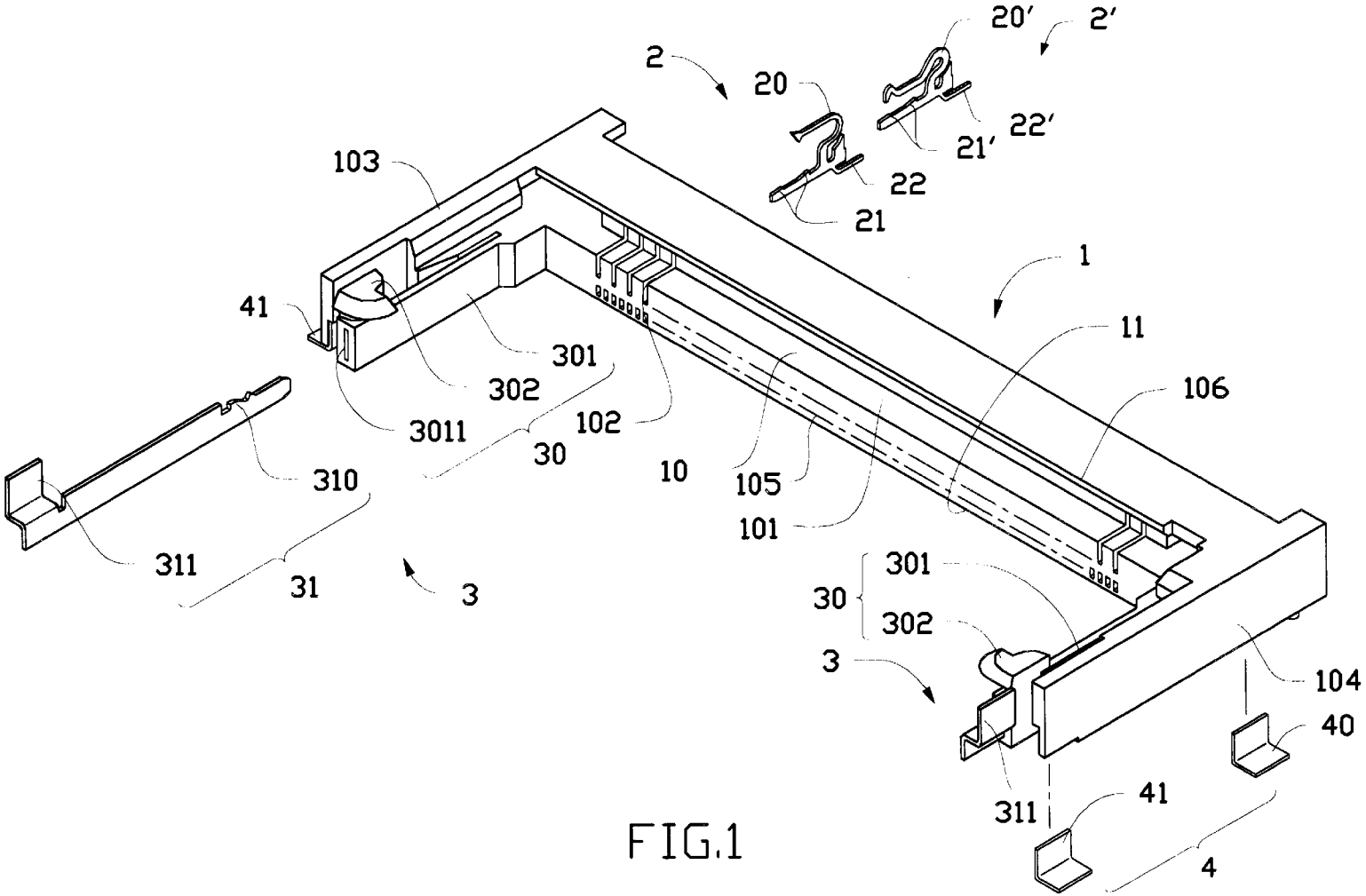
FIG. 1 is an exploded view of a card connector in accordance with the present invention.
Figure 2:
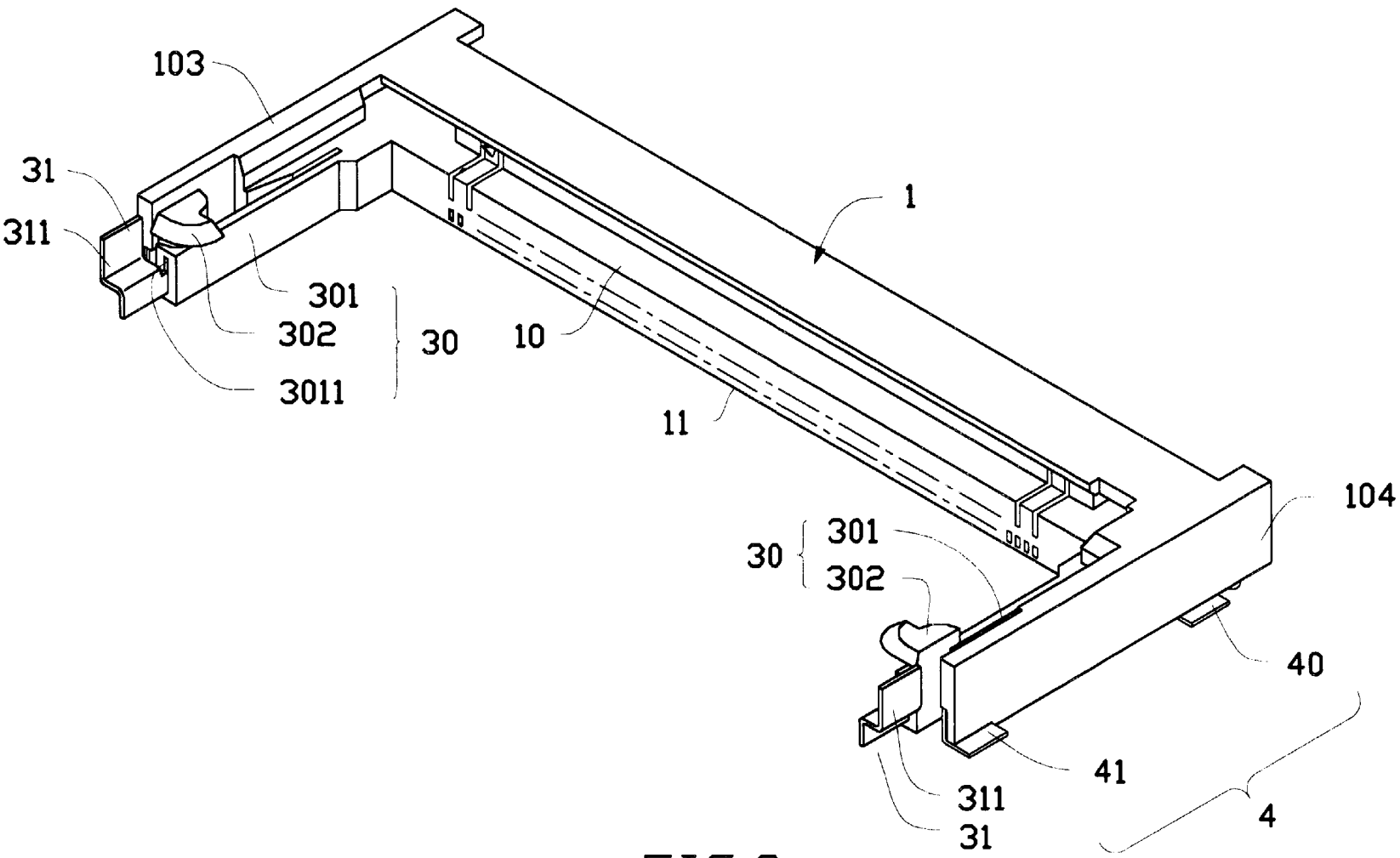
FIG. 2 is an assembled view of FIG. 1.

Referring to FIGS. 1 and 2, a card connector in accordance with the present invention comprises an insulative housing 1, a plurality of first contacts 2 and second contacts 2' paired and staggered with respect to each other, locking means 3, and positioning means 4. The insulative housing 1 is substantially a rectangular structure having a reception surface 10 and a soldering surface 11 adjacent to the reception surface 10. The reception surface 10 has a longitudinal slot 101 defined therein for receiving a complementary card 5 (shown in FIGS. 4A and 4B) and, more specifically, the slot 101 is defined between a lower elongate wall 105 and an upper elongate wall 106, wherein the lower elongate wall 105 is wider than the upper elongate wall 106 and defines a plurality of apertures 102 therethrough. First and second supporting arms 103, 104 respectively extend perpendicularly from opposite ends of the two elongate walls 105, 106 to form a U-shaped structure. The first and second supporting arms 103, 104 receive and fix the locking means 3 therein. The soldering surface 11 is mounted and soldered on a motherboard 6 (shown in FIG. 3) when the insulative housing 1 is connected to the motherboard 6.

The staggered contacts 2, 2' respectively comprise a curved contacting portion 20, 20', an engaging portion 21, 21' for engagement within a corresponding aperture 102 of the insulative housing 1, and a soldering portion 22, 22' for engagement with the motherboard 6 via a surface mount technology (SMT) soldering procedure after the staggered contacts 2, 2' are fixed in the insulative housing 1.

The locking means 3 comprises an opposite pair of locking members 30 made of elastic non-conductive material such as plastic and a pair of releasing members 31 made of metal. Each locking member 30 comprises an elastic bar 301 attached to one of the supporting arms 103, 104, a receptacle 3011 defined in the elastic bar 301, and an engaging portion 302 integrally formed with one end of the elastic bar 301. More specifically, the engaging portion 302 is a curved tab extending laterally from the elastic bar 301 for engaging with a corresponding cutout so defined in a complementary card 5 (shown in FIGS. 4A and 4B). Each releasing member 31 is substantially an elongate plate having a barbed head portion 310 for reception within the receptacle 3011 of the elastic bar 301 and a handle 311 for allowing a user to manually release the engagement between the complementary card 5 and the engaging portion 302 of each locking member 30. Specifically, the handle 311 is formed as an L-shaped plate having a first portion extending laterally from a free end of the releasing member 31 and a second portion extending perpendicularly from the first portion thereof. When a user simultaneously bends the two handles 311 outward, the engagement between the complementary card 5 and the engaging portions 302 is released.

Figure 3:
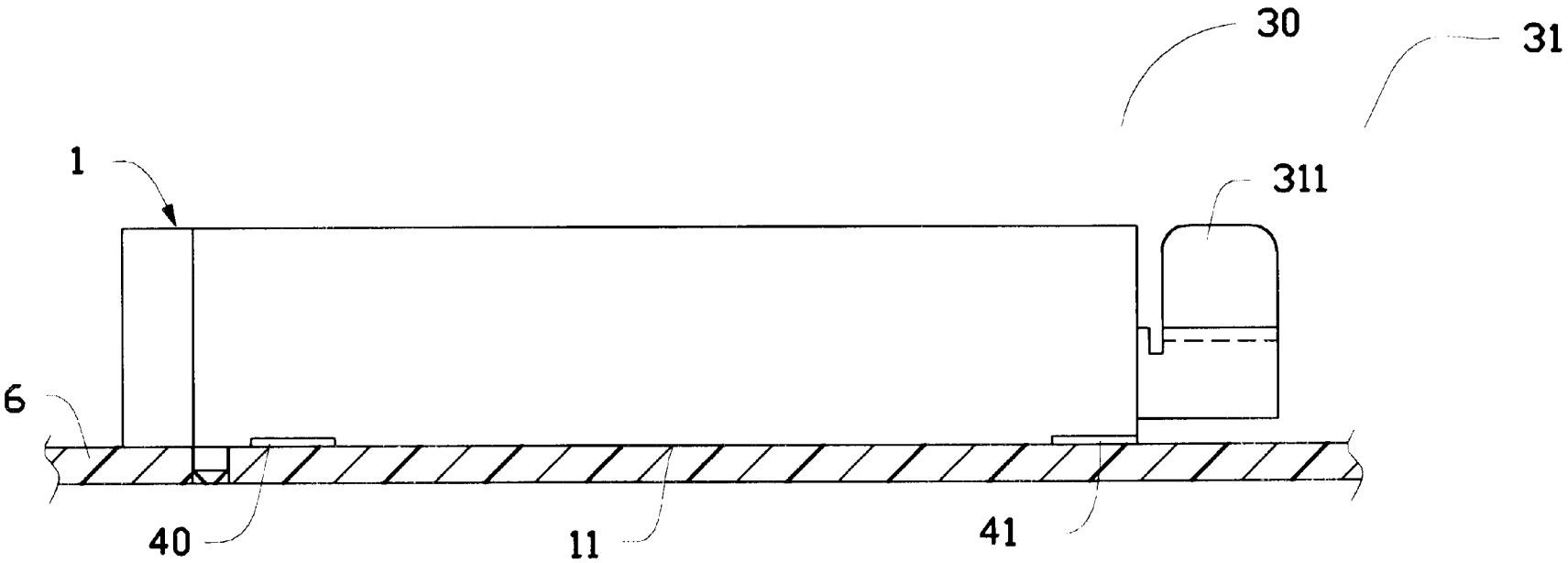
FIG. 3 is a left side elevational view of the card connector soldered on a motherboard, wherein the motherboard is shown in a cross-sectional view.

Also referring to FIG. 3, the positioning means 4 comprises two first positioning members 40 formed like L-shaped plates which are respectively engaged with the first and second supporting arms 103, 104 at intermediate portions thereof, and two second positioning members 41 formed like L-shaped plates which are respectively engaged with the first and second supporting arms 103, 104 at free ends thereof near the engaging portions 302 of the locking members 30. Specifically, an upright portion of each positioning member 40, 41 is engaged with the supporting arm 103 or 104, while a horizontal portion of each positioning member 40, 41 extends laterally from the corresponding supporting arm 103, 104 to be soldered on the motherboard 6 for reinforcing the engagement between the connector and the motherboard 6 thereby preventing the connector from becoming loosened from the motherboard 6 during the reversed step of the wave soldering procedure and during the insertion/withdrawal of the complementary card 5.

Figure 4A:
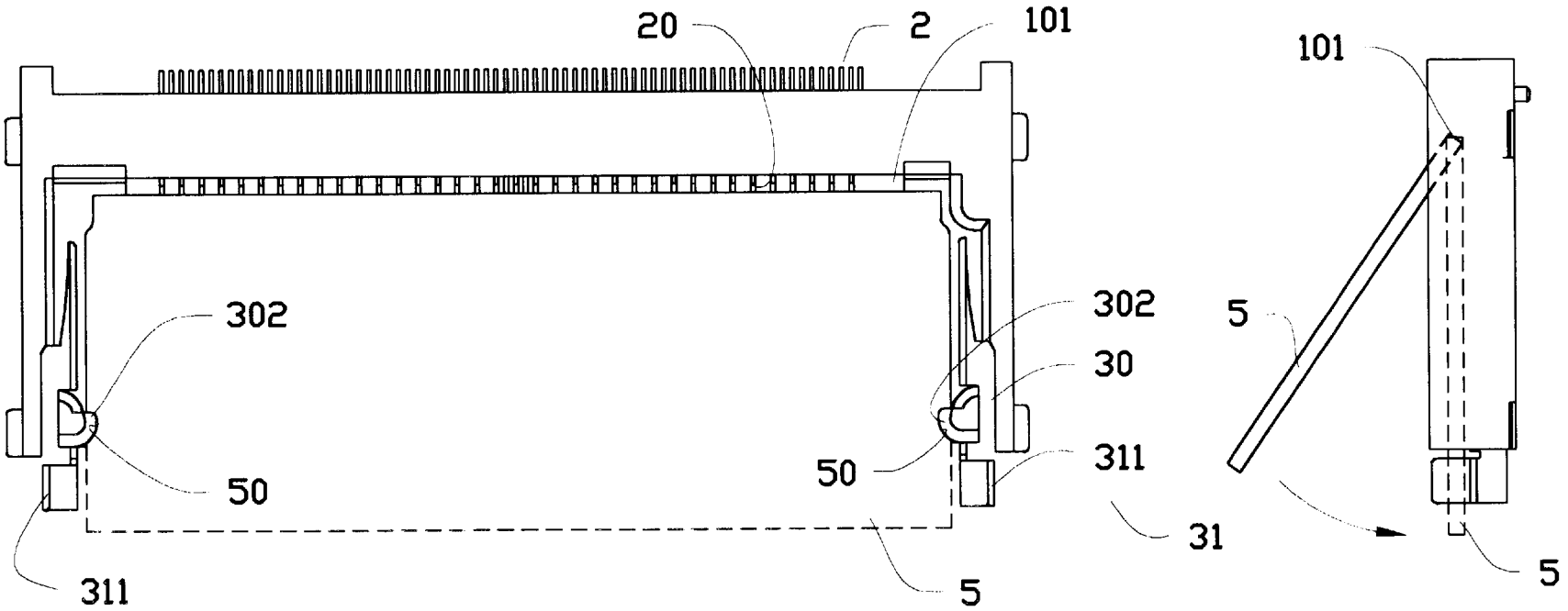
FIG. 4A illustrates the module board of the card connector in a locked status.
Figure 4B:
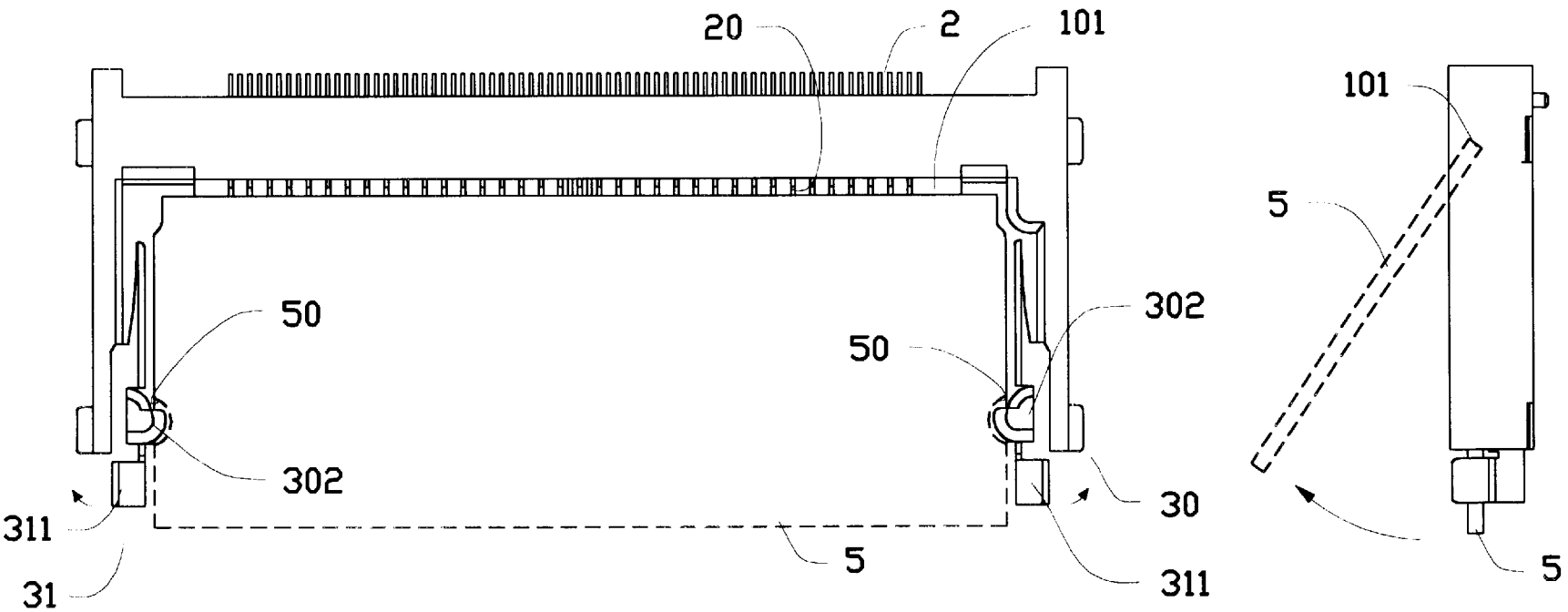
FIG. 4B illustrates the module board of the card connector in a released status.

FIGS. 4A and 4B illustrate the insertion/withdrawal of the complementary card 5 for further explanation of the reinforcing effect of the positioning members 40, 41. The complementary card 5 is initially inserted into the slot 101 of the connector from an inclined direction (shown in solid lines) and then depressed for engagement with the engaging portion 302 of the locking member 30 as shown in FIG. 4A. To withdraw the complementary card 5, the handles 311 of the releasing members 31 are bent outward to release the engagement between the engaging portions 302 of the connector and the cutouts 50 of the complementary card 5.

It is noted that the barbed head portion 310 of the releasing member 31 is retainably embedded within the housing 1 so the releasing member 31 has it own retention with regard to the housing 1. Also, the locking member 30 provides the receptacle 3011 around the front end of the elastic bar 301 for allowing receipt of the main elongated plate of the releasing member 31 therein, so that the cooperative engagement between the receptacle 3011 and the elongated plate of the releasing member 31 provides mutual common motion relationship therebetween for using the releasing member 31 to actuate the locking member 30. The structure of the invention prevents any disengagement between the locking member 30 and the corresponding releasing member 31, thus assuring a reliable actuation of the releasing member 31 to the locking member 30.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. A card connector for receiving a complementary card comprising:

an elongate insulative housing including a first elongate wall, a second elongate wall opposite the first elongate wall and defining a plurality of passageways therein, a slot defined between the first and the second elongate walls and communicating with the passageways, and first and second supporting arms respectively integrated with the two elongate walls and extending substantially perpendicular therefrom;

a plurality of contacts received in the passageways and projecting into the slot;

first and second elastic locking members extending from two distal ends of the first elongate wall and spaced from the first and second supporting arms for engagement with the complementary card which is inserted into the slot of the housing; and positioning means made of metal and engaged with at least one of the first and second supporting arms for being soldered on a motherboard thereby reinforcing the engagement between the contacts and the motherboard during insertion/withdrawal of the complementary card;

wherein the positioning means comprises at least two positioning members each of which is an L-shaped plate respectively engaged with the first and second supporting arms; and wherein the elastic locking members can be manually bent outward with respect to an axis therebetween for releasing the engagement between the complementary card and the connector.

2. The card connector as claimed in claim 1, wherein the first and the second elastic locking members each comprise an elastic bar and an engaging portion projecting from a free end of each elastic bar for engaging with a cutout portion defined in the complementary card.

3. The card connector as claimed in claim 1 further comprising a releasing member engaging with each elastic locking member and being operative to bend the two locking members outward with respect to an axis therebetween for releasing the complementary card.

4. The card connector as claimed in claim 3, wherein each locking member defines a receptacle therein for firmly receiving the releasing member.

5. The card connector as claimed in claim 4, wherein each releasing member is an elongate metal plate which contains a barb head portion for engagement within the receptacle of the locking member and a handle operative to bend the locking members outward with respect to an axis therebetween so as to release the engagement between the complementary card and the locking member.

6. The card connector as claimed in claim 5, wherein the handle of each releasing member is formed as an L-shaped plate having a first portion extending laterally from a free end of the releasing member and a second portion extending perpendicularly from the first portion thereof.

7. The card connector as claimed in claim 2, wherein the engaging portion is a curved tab extending laterally from the elastic bar.

8. A card connector including an insulative elongated housing defining a slot for receiving a card therein;

at least one supporting arms formed with the housing and extending substantially perpendicular to the housing;

a plurality of contacts positioned by at least one side of the slot and projecting into the slot for engagement with the card, at least one elastic locking member extending from one distal end of the housing adjacent to said corresponding supporting arm;

said locking member including a deflectable elastic bar integrally attached to the corresponding supporting arms and said elastic bar defining a receptacle therein;

a releasing member including an elongated plate with barbed head portion and adapted to be inserted into the receptacle of the locking member and retained with the housing for actuating said deflectable elastic bar of the locking member to be outward deflected.

9. A card connector for receiving a complementary card comprising:

an elongate insulative housing including a first elongate wall, a second elongate wall opposite the first elongate wall and defining a plurality of passageways therein, a slot defined between the first and the second elongate walls and communicating with the passageways, and first and second supporting arms respectively integrated with the two elongate walls and extending substantially perpendicular therefrom;

a plurality of contacts received in the passageways and projecting into the slot;

first and second elastic locking members extending from two distal ends of the first elongate wall and spaced from the first and second supporting arms for engagement with the complementary card which is inserted into the slot of the housing; and positioning means made of metal and engaged with at least one of the first and second supporting arms for being soldered on a motherboard thereby reinforcing the engagement between the contacts and the motherboard during insertion/withdrawal of the complementary card;

wherein the positioning means includes a first positioning member engaged with one supporting arm near an engaging portion of one corresponding locking member, and a second positioning member engaged with the same one supporting arm near an intermediate portion thereof; and wherein the elastic locking members can be manually bent outward with respect to an axis therebetween for releasing the engagement between the complementary card and the connector.

* * * * *